US010010728B2

(12) United States Patent
Mashiko

(10) Patent No.: US 10,010,728 B2
(45) Date of Patent: Jul. 3, 2018

(54) RESPIRATORY PROTECTION DEVICE

(71) Applicant: KOKEN LTD., Chiyoda-ku, Tokyo (JP)

(72) Inventor: Yoshimitsu Mashiko, Tokyo (JP)

(73) Assignee: KOKEN LTD., Tokyo (JP)

( * ) Notice: Subject to any disclaimer, the term of this patent is extended or adjusted under 35 U.S.C. 154(b) by 539 days.

(21) Appl. No.: 14/406,971

(22) PCT Filed: Jun. 3, 2013

(86) PCT No.: PCT/JP2013/065400
§ 371 (c)(1),
(2) Date: Dec. 10, 2014

(87) PCT Pub. No.: WO2013/187279
PCT Pub. Date: Dec. 19, 2013

(65) Prior Publication Data

US 2015/0107596 A1 Apr. 23, 2015

(30) Foreign Application Priority Data

Jun. 15, 2012 (JP) ..... 2012-136349

(51) Int. Cl.
*A62B 18/08* (2006.01)
*A62B 27/00* (2006.01)
(Continued)

(52) U.S. Cl.
CPC ..... *A62B 18/08* (2013.01); *A62B 18/02* (2013.01); *A62B 18/025* (2013.01); *A62B 18/10* (2013.01); *A62B 27/00* (2013.01); *A62B 9/02* (2013.01)

(58) Field of Classification Search
CPC .. A61M 16/00; A61M 16/06; A61M 16/0605; A61M 16/20; A61M 16/22;
(Continued)

(56) References Cited

U.S. PATENT DOCUMENTS 3,645,261 A * 2/1972 West ..... A62B 18/086 128/201.19
5,647,356 A * 7/1997 Osendorf ..... A62B 27/00 128/202.27
(Continued)

FOREIGN PATENT DOCUMENTS

JP 60-99946 U 7/1985
JP 60-99947 U 7/1985
JP 61-54851 U 4/1986
(Continued)

OTHER PUBLICATIONS

Machine Translation of JP 2007-181570, 8 pages.*
(Continued)

*Primary Examiner* — Colin W Stuart
(74) *Attorney, Agent, or Firm* — Hauptman Ham, LLP

(57) ABSTRACT

A respiratory protection device in which a plurality of filter units are provided. A respiratory protection device includes a plurality of filter units. Air flow paths that extend to the facepiece are provided in respective filter units. An inhalation port leading in the facepiece is provided at a portion where the air flow paths merge. The inhalation port can be temporarily closed by using an inspection valve included in the fit checker.

2 Claims, 5 Drawing Sheets

(51) Int. Cl.

| | |
|---|---|
| ***A62B 18/02*** | (2006.01) |
| ***A62B 18/10*** | (2006.01) |
| *A62B 9/02* | (2006.01) |

(58) Field of Classification Search

CPC .... A61M 2016/0661; A62B 7/00; A62B 9/00; A62B 9/006; A62B 9/02; A62B 9/025; A62B 9/04; A62B 18/00; A62B 18/02; A62B 18/025; A62B 18/06; A62B 18/08; A62B 18/088; A62B 18/10; A62B 19/00; A62B 23/00; A62B 23/02; A62B 27/00; A62B 18/086

USPC ..... 128/205.24, 205.25, 205.27, 205.29, 128/206.12, 206.15, 206.17, 206.21, 128/207.12

See application file for complete search history.

(56) References Cited

U.S. PATENT DOCUMENTS

| | | | | |
|---|---|---|---|---|
| 6,408,845 | B1 * | 6/2002 | Pereira | A62B 23/02 128/201.17 |
| 2004/0003810 | A1 * | 1/2004 | Templeton | A62B 17/04 128/201.22 |
| 2008/0093399 | A1 * | 4/2008 | Resnick | A45F 3/16 224/148.2 |

FOREIGN PATENT DOCUMENTS

| | | | |
|---|---|---|---|
| JP | 2007-181570 | A | 7/2007 |

OTHER PUBLICATIONS 5 pages of International Search Report dated Jun. 25, 2013 in International Application No. PCT/JP2013/065400 filed Jun. 3, 2013.

* cited by examiner

RESPIRATORY PROTECTION DEVICE

RELATED APPLICATIONS

The present application is a National Phase of International Application Number PCT/JP2013/065400, filed Jun. 3, 2013, which claims priority to Japanese Application Number 2012-136349, filed Jun. 15, 2012.

TECHNICAL FIELD

The present invention relates to a respiratory protection device such as a dust mask and a protection mask and more particularly relates to a respiratory protection device inclusive of a filter unit.

BACKGROUND

There have been conventionally known respiratory protection devices in which a filter unit inclusive of a filter for removing dust and the component of poisonous gases is mounted on a facepiece. Also, there have been conventionally known respiratory protection devices in which a plurality of filter units are mounted on the facepiece.

For example, a protection mask disclosed by Japanese Unexamined Patent Application Publication No. 2007-181570 (P2007-181570A, Patent Literature 1) includes filter units respectively mounted on the bilateral sides of a center line that bisects the width of a facepiece. Respective filter units are linked to the inner side of the facepiece through separate inhalation ports formed in the facepiece. In the facepiece, a check valve for inhalation is mounted to each of the inhalation ports. A filter incorporated in the filter unit can be detachably provided to a cup in the filter unit.

CITATION LIST

Patent Literature

{PTL 1} JP 2007-181570 A (P2007-181570A)

SUMMARY

Technical Problem

Conventional protection masks, in which inhalation valves are used, needs the number of check valves for inhalation in accordance with the number of filter units, which causes a problem in that the structure of the protection mask is considerably complicated. Also, when the protection mask is of a mask including a fit checker that determines whether or not a worn condition is appropriate, the fit checker needs individual shatter plates that can simultaneously block air flow paths temporarily, each of which extends from each filter unit to the facepiece, which involves structural complexity.

Accordingly, the present invention has been achieved to solve the problems, and regarding a respiratory protection device such as a protection mask inclusive of a plurality of filter units, it is an object of the present invention to improve the structure of the respiratory protection device, which is aimed at reducing the number of check valves for inhalation used therein or reducing the number of inspection valves used in the fit checker.

Solution to Problem

In order to solve this problem, the present invention relates to a respiratory protection device configured to include a facepiece formed in such a manner as to inhale and exhale and a plurality of filter units provided on the facepiece, and configured to connect the facepiece to respective filter units in a breathable manner.

The respiratory protection device according to the present invention includes the following features: air flow paths that extend to the facepiece and converge with each other at a tip end portion thereof being provided in respective filter units. The respiratory protection device further includes an inhalation port leading in the facepiece at a portion where the air flow paths merge, a fit checker configured to determine whether a worn condition of the respiratory protection device is appropriate, by temporarily closing the inhalation port and temporarily blocking a flow of inhalation into the facepiece, and an inspection valve included in the fit checker being used, thereby temporarily closing the inhalation port.

Advantageous Effects of Invention

In the respiratory protection device according to the present invention, the air flow paths, which extend from the plurality of filter units provided on the facepiece to the facepiece, merge with each other at the tip end portion thereof. In the respiratory protection device, the inhalation port leading in the facepiece is provided at the portion where the air flow paths merge. Accordingly, the respiratory protection device has only to mount the check valve for inhalation to the inhalation port or prepare the fit checker, so that the number of inhalation valves can be reduced, and the number of inspection valves used for the fit checker can be reduced, which simplifies the structure of the respiratory protection device, compared with the conventional respiratory protection devices in which the check valve for inhalation is mounted on each of the plurality of filter units, or the fit checker is prepared for each of the plurality of filter units.

DESCRIPTION OF EMBODIMENTS

A respiratory protection device according to the present invention will be discussed in detail with reference to the attached drawings as follows.

Figure 1:
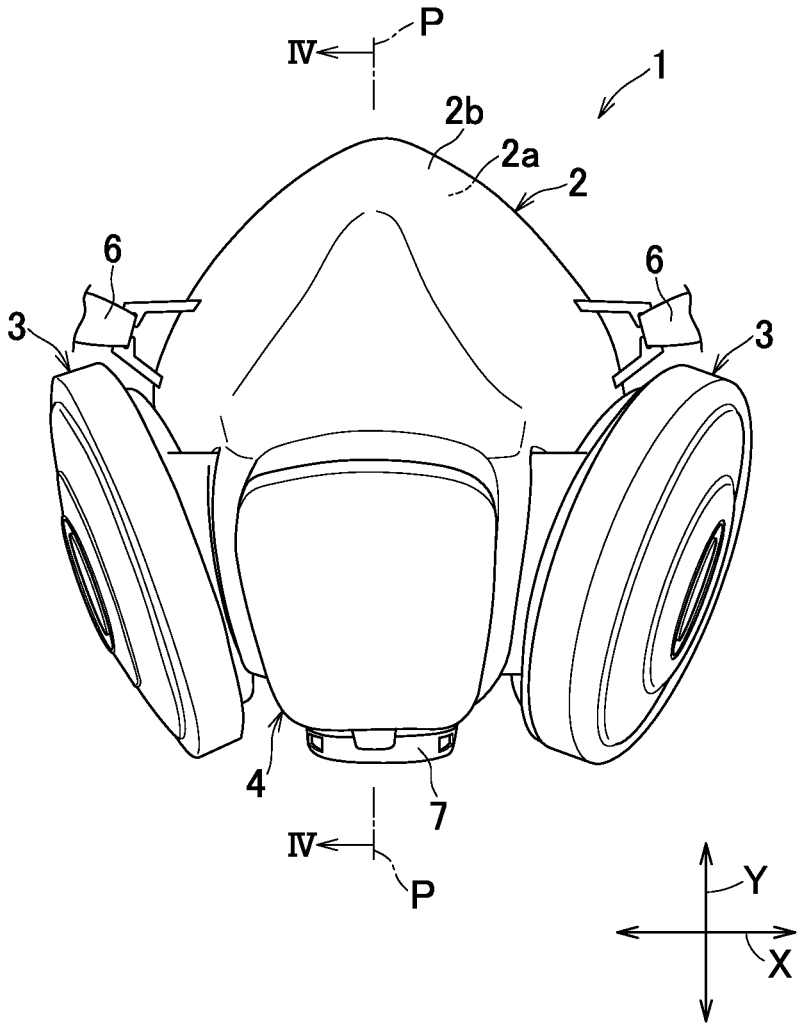
FIG. 1 is a front view of a half-face type mask illustrated as one example of a respiratory protection device.

FIG. 1 is a front view of a half-face type mask 1 illustrated as one example of the respiratory protection device. The mask 1 includes a facepiece 2, filter units 3 mounted on the bilateral side portions of the right and left of the facepiece 2, and a fit checker unit 4 mounted on the central portion in the crosswise direction X of the facepiece 2. It is noted that the filter unit 3 is also referred to as an inhalation cup. The facepiece 2 also includes an inner surface 2*a* (see FIG. 4) facing the face of the wearer (not illustrated) of the mask 1 and an outer surface 2*b*, which is the surface opposite to the inner surface 2*a*, and adjustable straps 6 that fasten the head are coupled on the outer surface 2*b*, and a breathable cover 7 with respect to a check valve for exhalation (not illustrated) is mounted below the central portion. A two-headed arrow X illustrated in the drawing represents the crosswise direction of the facepiece 2, and a two-headed arrow Y represents the vertical direction of the facepiece 2. It is noted that the vertical direction Y is also represented as an up-and-down direction Y with regard to the mask 1. A line P-P is a center line that bisects the dimension of the crosswise direction X of the mask 1, and the mask 1 illustrated in the example is approximately symmetrical to the center line P-P. The right and left with regard to the mask 1 means the right and left for the mask wearer.

Figure 2:
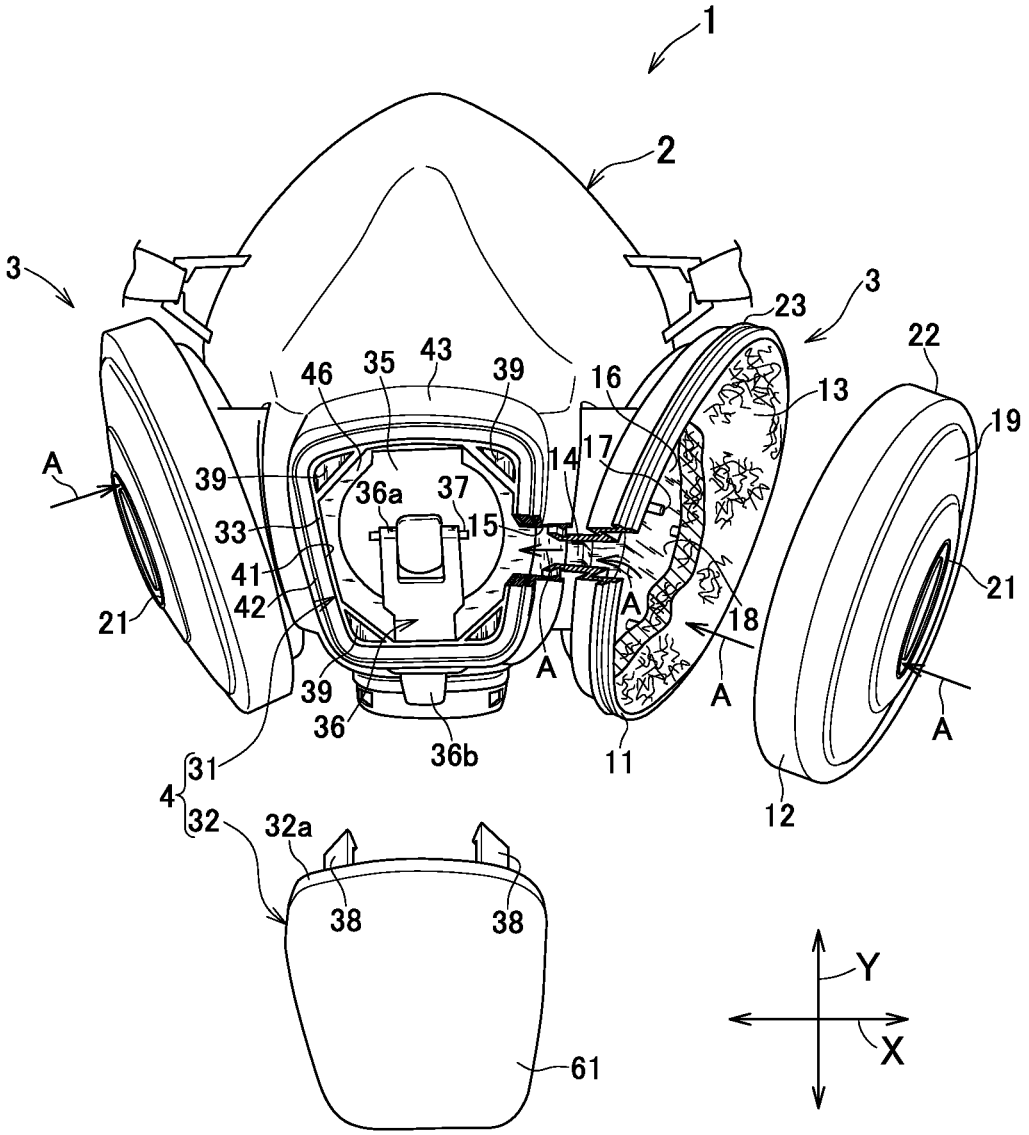
FIG. 2 is a partially broken front view of the half-face type mask in which a cap of a fit checker unit is detached.

FIG. 2 is a view of the mask 1 illustrated in FIG. 1, which is partially exploded and broken. Regarding the filter units 3, the left one is in an exploded, broken state, and the right one is in an assembled state. As is obvious from the left filter unit 3, each filter unit 3 includes a filter cartridge 11, a breathable cap 12 that is detachably mounted to the cartridge 11, and an exchangeable filter 13 put in the cartridge 11.

An air flow path 14 is formed between the cartridge 11 and the fit checker unit 4. A plurality of pin-shaped portions 17 are extended from the inner surface 16 of the bottom portion of the cartridge 11 to the filter 13, thereby defining a permeable clearance 18 between the inner surface 16 of the bottom portion and the filter 13. Regarding the cap 12, a draft hole 21 is in the center of a circular frontal portion 19. Furthermore, regarding the cap 12, the inner surface of a cylindrical peripheral wall portion 22 is detachably screwed to a spiral portion 23 in the cartridge 11. The cartridge 11 and the cap 12 are formed of rigid plastics such as an ABS resin.

The fit checker unit 4 includes a valve holder 31 and a cap 32 that is detachably mounted to the valve holder 31, and the diagram represents a state where the cap 32 is detached from the valve holder 31. The valve holder 31 includes a top wall portion 33 having in an approximately square shape, and an inspection valve 35 is visible at the center on the inner side of the top wall portion 33. An operation lever 36 extended in the vertical direction Y is mounted on the inspection valve 35.

The lever 36 is disposed for performing the operation of opening and closing the inspection valve 35. The upper end portion of the lever 36 is a mounting portion 36*a* to the inspection valve 35 and turnably/swingably mounted on the inspection valve 35 with a connector pin 37. The lower end portion of the lever 36 is an operational portion 36*b* of the lever 36, and the operational portion 36*b* extends to the outside of the top wall portion 33. The inspection valve 35 is formed of elastic materials such as natural rubber and synthetic rubber, and the valve holder 31, the cap 32, and the lever 36 are formed of rigid plastics such as, for examples, an ABS resin.

An arrow A in FIG. 2 represents the flow of air in the air flow paths 14 when the mask 1 is worn. Outside air enters the filter unit 3 through the draft hole 21, and the air passes through the filter 13 and is filtered into clean air, which enters the inner side of the valve holder 31 through the air flow paths 14. The air flow paths 14, which are extended from the fit checker unit 4 and disposed on the right and left sides, are merged in the valve holder 31. In order to make such flow of air, an external peripheral surface portion of the cartridge 11, which is a portion that serves as the air flow path 14 in the filter unit 3, is engaged airtight in an opening 15 of the facepiece 2. The valve holder 31 in the fit checker unit 4 is fitted in an opening 41 of the facepiece 2. Also, when leg portions 38 disposed in the four corners of the cap 32 are inserted into leg holes 39 disposed in the four corners of the top wall portion 33 of the valve holder 31, the cap 32 is integrated with the valve holder 31. The valve holder 31 is surrounded by the peripheral wall portion 43 of the facepiece 2, and the peripheral edge portion 32*a* of the cap 32 enters a groove 42 formed in a top portion 43*a* of the peripheral wall portion 43, thereby airtightly sealing a gap between the cap 32 and the facepiece 2 (see FIG. 4). Accordingly, when the facepiece 2 in FIG. 1 is in an airtightly sealed state relative to the face of a wearer, outside air is prevented from intruding into the valve holder 31 through between the cap 32 and the facepiece 2.

Figure 3:
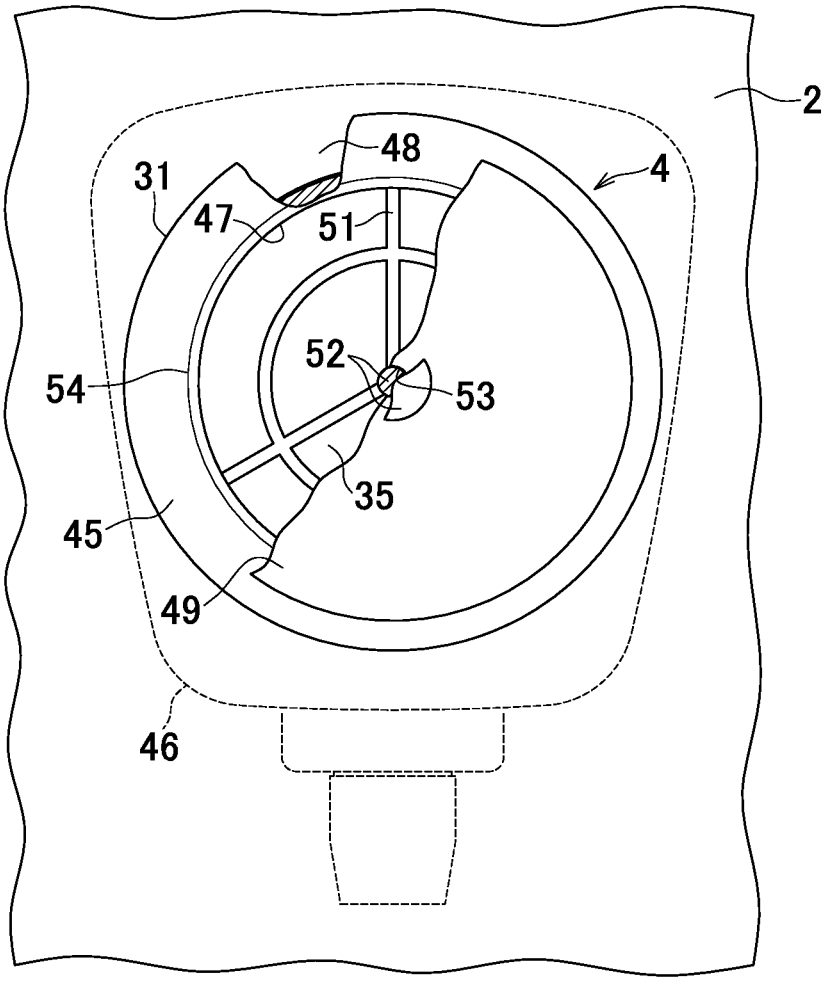
FIG. 3 is a view of the fit checker unit whose inner surface side is partially broken and illustrated.

FIG. 3 is a view of the fit checker unit 4 and its vicinity viewed from the inner side of the facepiece 2. The valve holder 31 of the fit checker unit 4 includes a bottom surface portion 46 (see FIG. 4) having an approximately square shape and a flange 45 having an approximately doughnut shape, and an inhalation port 47 penetrates both portions 45 and 46. The fit checker unit 4 includes the inspection valve 35 in FIG. 2 that opens and closes from the outside of the facepiece 2 with respect to the inhalation port 47 and a check valve 49 for inhalation in FIG. 3 that opens and closes from the inner side of the facepiece 2 with respect to the inhalation port 47. The check valve 49 for inhalation, which is conventional one in the field of the respiratory protection devices, includes a mounting hole 53, and a portion inclusive of the hole 53 is fitted with an undercut protrusion portion 52 formed in ribs 51 extended in the radial direction of the inhalation port 47 (see FIG. 4). An inner-side valve seat 54 relative to the check valve 49 for inhalation is formed on the peripheral edge portion of the inhalation port 47.

Figure 4:
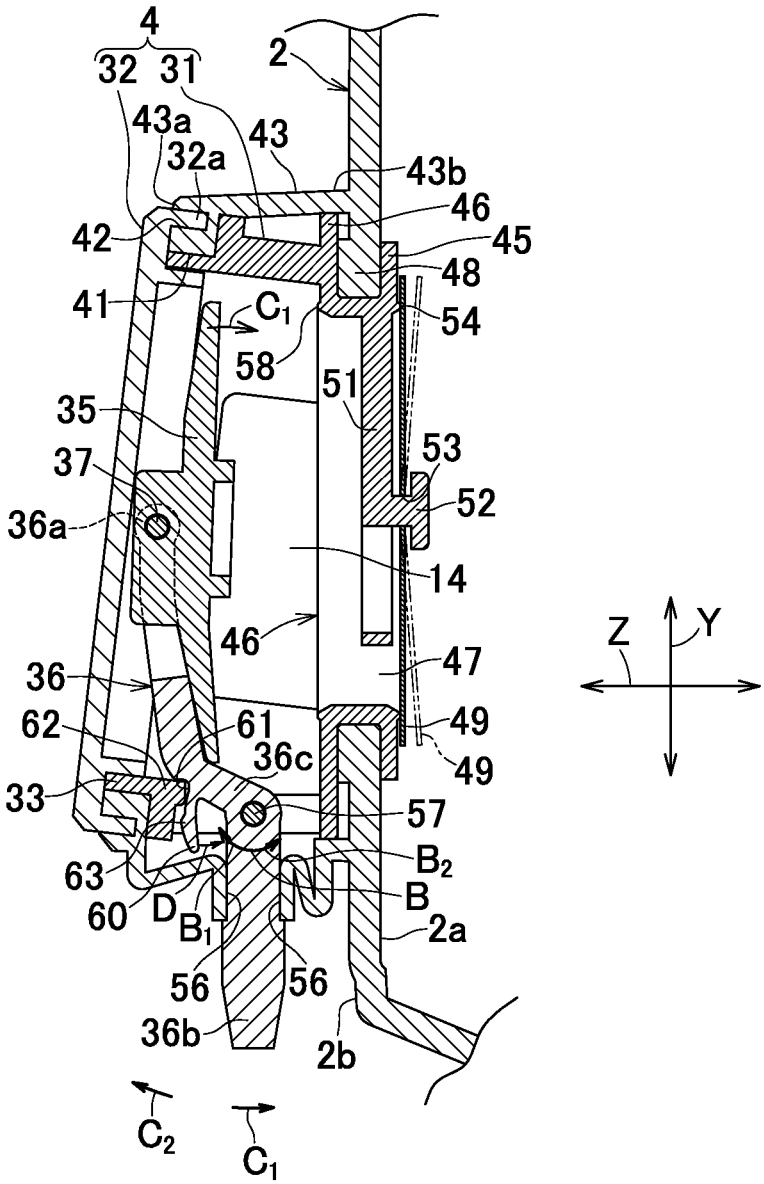
FIG. 4 is a cross-sectional view taken along the line IV-IV of FIG. 1.
Figure 5:
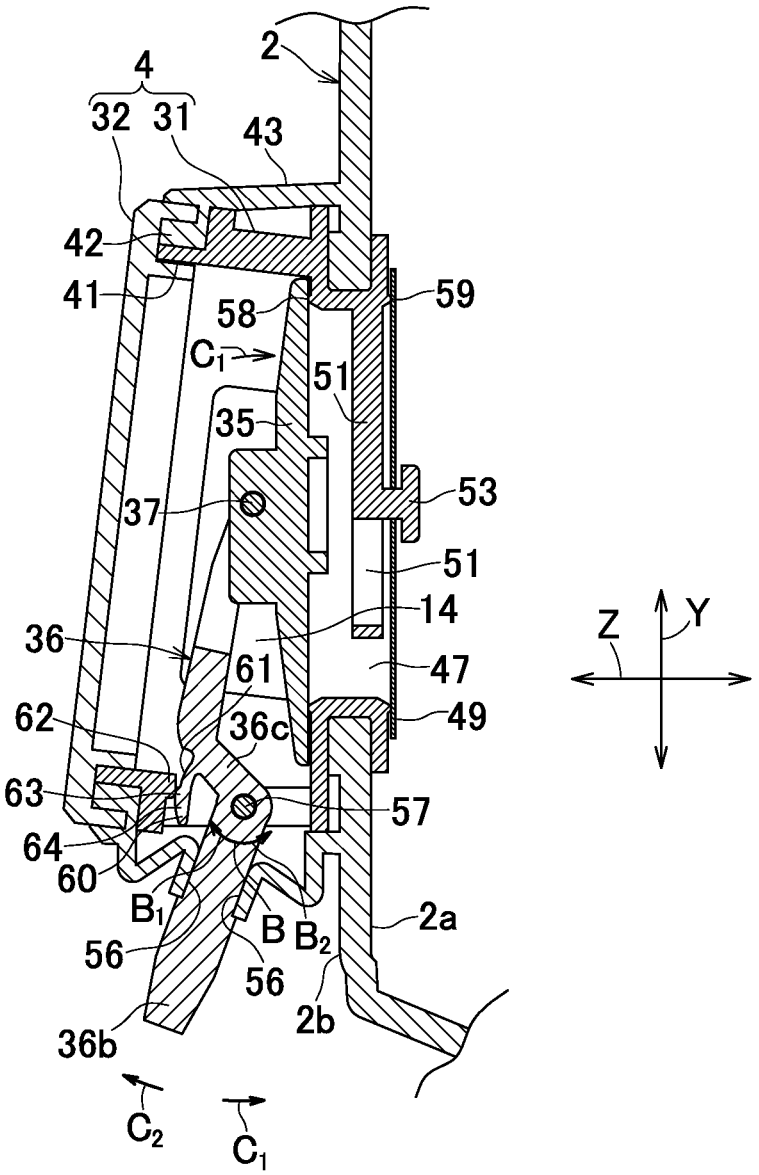
FIG. 5 is a cross-sectional view taken along the line IV-IV of FIG. 1 in which an inspection valve is in a closed state.

FIGS. 4 and 5 are cross-sectional views taken along the line IV-IV of FIG. 1, and the inspection valve 35 is open from the inhalation port 47 in FIG. 4, and the inspection valve 35 is closed to the inhalation port 47 in FIG. 5.

In the facepiece 2 in FIG. 4, the cap 32 and the top portion 43*a* of the peripheral wall portion 43, which forms the fitting portion 41, are airtightly in close contact with each other, and the portion 48 of the facepiece 2, which is connected to the base end portion 43*b* of the peripheral wall portion 43, is airtightly in close contact with the flange 45 and the bottom surface portion 46 of the valve holder 31. Also, the peripheral edge portion of a tubular portion 56 formed in the peripheral wall portion 43 is airtightly in close contact with the periphery of the lever 36 inserted into the tubular portion 56. However, the cap 32 may be removed from the facepiece 2 by elastically deforming the top portion 43*a* of the peripheral wall portion 43. Also, the lever 36 has an intermediate portion 36*c* between the mounting portion 36*a* and the operational portion 36*b* mounted to the peripheral wall portion 43 with a pin 57, so that the lever 36 may reciprocatively turn. Since it may be said that the fit checker unit 4 is integrated with the facepiece 2 it may also be said that the lever 36 is reciprocatably and turnably mounted about the pin 57 on the facepiece 2. When the above-mentioned lever 36 reciprocatively turns in a range illustrated by a two-headed arrow B, the operational portion 36*b* repeats a turn in a first direction C1 advancing from the outer surface 2*b* to the inner surface 2*a* of the facepiece 2 and a turn in a second direction C2 advancing from the inner surface 2*a* to the outer surface 2*b* of the facepiece 2.

FIG. 4 represents a state where the lever 36 is turned in the counterclockwise direction B2, out of the directions illustrated by the two-headed arrow B and a state where the operational portion 36*b* turns in the first direction C1, and the inspection valve 35 of the mounting portion 36*a* is detached from an outer-side valve seat 58 formed at the peripheral edge of the inhalation port 47. Regarding the lever 36 in this state, an engaging concave portion 61 of an arm-shaped, elastic cam follower 60 formed on the intermediate portion 36*c* is pressure-contacted with a cam 62 formed in the valve holder 31, thereby preventing the turn of the lever 36 in the clockwise direction B1. The air flow path 14 connected to the filter unit 3 is visible in the valve holder 31 in FIG. 4.

When the mask 1 is worn and placed in the state illustrated in FIG. 4, and a wearer performs the inhalation movement, clean air flows through the air flow paths 14, which are extended from the filter units 3 disposed on the right and left sides, and merges in the valve holder 31, and furthermore the clean air pushes open the check valve 49 for inhalation mounted in the inhalation port 47 and enters in the facepiece 2 and is used as air for inhalation. It is noted that, in FIG. 4, a solid line illustrates the check valve 49 for inhalation that is in close contact with the inner-side valve seat 54 formed at the peripheral edge of the inhalation port 47, thereby closing the inhalation port 47, and an imaginary line illustrates the check valve 49 for inhalation that is detached from the inner-side valve seat 54, thereby opening the inhalation port 47.

FIG. 5 represents the state of the inspection valve 35 of a case where the operational portion 36*b* of the lever 36 in FIG. 4 is turned in the second direction C2. When the fingertip of a wearer is placed on the operational portion 36*b*, and the operational portion 36*b* is turned in the second direction C2, the inspection valve 35 turns in the first direction C1 advancing from the outer surface 2*b* to the inner surface 2*a* of the facepiece 2 about the pin 57. The turn allows the inspection valve 35 to come close to the inhalation port 47 from the front in the back-and-forth direction Z illustrated by the two-headed arrow as if it arced, and the inspection valve 35 is in close contact with the outer-side valve seat 58 formed at the peripheral edge portion of the inhalation port 47, thereby closing the inhalation port 47. Thus, when the lever 36 is turned in the clockwise direction B1 by turning the operational portion 36*b* in the second direction C2, the arm-shaped, elastic cam follower 60 formed on the lever 36 is pressure-contacted with the cam 62 and elastically deformed in a direction illustrated by an arrow D (see FIG. 4), and contact between the engaging concave portion 61 of the cam follower 60 and the cam 62 is released, and a portion 64 beyond the engaging convex portion 63 of the cam follower 60 is pressure-contacted with the cam 62. The above-mentioned pressure contact of the cam follower 60 against the cam 62 can energize the lever 36 in such a manner as to turn the lever 36 in the clockwise direction B1, and the inspection valve 35 can be pressure-contacted with the outer-side valve seat 58, and simultaneously, the inspection valve 35 can be prevented from being detached from the outer-side valve seat 58. Thus, the cam follower 60 acts as an energizing means in response to the lever 36. The portion 64 of the cam follower 60 and the cam 62 in FIG. 5 are pressure-contacted with each other at an upper position above the pin 57 in the up-and-down direction Y such that the inspection valve 35 can be pressure-contacted with the outer-side valve seat 58 by means of the cam follower 60.

When the mask 1 is used, the lever 36 is operated from the outside of the air flow paths 14, and the inspection valve 35 is placed in the state in FIG. 4 to be worn. Subsequently, the facepiece 2 is brought into close contact with the face of a wearer, and the lever 36 is operated in such a manner as to turn in the clockwise direction B1, and the inspection valve 35 is turned in the first direction C1, and the inspection valve 35 is in close contact with the outer-side valve seat 58, thereby closing the inhalation port 47. Herein, when respiration is repeatedly performed, and air does not make its way into the facepiece 2, and a wearer has a sense of having difficulty in breathing, it is determined that the airtight state between the facepiece 2 and the face of the wearer is favorable. Subsequently, the operational portion 36*b* is turned in the first direction C1, and the lever 36 is operated in such a manner as to turn in the counterclockwise direction B2, and the inspection valve 35 is turned in the second direction C2 and detached from the outer-side valve seat 58, and the inhalation port 47 is opened, thereby starting the use of the mask 1.

Regarding the mask 1, in which the lever 36, which serves as an operating means with respect to the inspection valve 35, is operated from the outside of the air flow paths 14, and the inspection valve 35 is turned in the first direction C1 and the second direction C2, in other words, the inspection valve 35 is transferred in the back-and-forth direction Z of the facepiece 2 as if it arced, and the inspection valve 35 is in close contact with or detached from the outer-side valve seat 58, there is no problem in that the inspection valve 35 suffers abrasion or damage due to the sliding of the inspection valve 35 against the valve seat or the like. Accordingly, the wearer's troublesomeness can be alleviated during the operations such as periodic inspection for the inspection valve 35 or the outer-side valve seat 58. Also, the direction that the inspection valve 35 turns is the back-and-forth direction Z of the facepiece 2, and the inspection valve 35 that turns in the above-mentioned manner does not traverse the wearer's field of vision, so that the adoption of the fit checker unit 4 is useful in widening the field of vision when the mask 1 is worn. When the lever 36 that turns the inspection valve 35 is one that turns the operational portion 36*b* of the lever 36 below the facepiece 2 as illustrated in the example, and the size of the operational portion 36*b* is increased in order to facilitate the operation of the lever 36, the operational portion 36*b* does not enter the field of vision.

Thus, regarding the mask 1 according to the present invention, the facepiece 2 includes a plurality of the filter units 3, and the air flow paths 14 that are extended from the respective plurality of filter units 3 to the facepiece 2 merge with each other at the tip end portion thereof, and the fit checker unit 4, which is a portion where the air flow paths 14 merge, is connected to the inhalation port 47 of the facepiece 2. Accordingly, although the mask 1 includes the plurality of filter units 3, the inhalation port 47 is one, so that the number of check valves 49 for inhalation that are used for the inhalation port 47 can be one, and the number of inspection valves 35 used for the fit checker unit 4 may be one. Consequently, for example, the mask 1 according to the present invention is simple in structure, which facilitates maintenance and inspection for the check valve 49 for inhalation and the fit checker unit 4, compared with conventional respiratory protection devices in which each inhalation port is formed for the two filter units.

The present invention described based on the example of the half-face type mask can be applied for a full-face type mask. Also, in the example illustrated, the two filter units 3 are provided on the facepiece 2, but three filter units or more may be provided on the facepiece 2. In the example illustrated, the check valve 49 for inhalation is incorporated in the fit checker unit 4, but can be mounted on the facepiece 2 by means of a separate member independent of the unit 4. Furthermore, the present invention can be applied for respiratory protection devices such as the half-face type mask and the full-face type mask, which do not include the check valve 49 for inhalation. The mask 1 in the example illustrated extends the peripheral wall portion 43 of the facepiece 2 in such a manner as to cover the inspection valve 35, in place of the cap 32, and the fit checker unit that is formed by the valve holder 31, the inspection valve 35, and the lever 36 can be set on the inner side of the extended portion. The lever 36 in FIG. 4 is one that is turned in the clockwise direction B1 and in the counterclockwise direction B2 by manual operation, but the lever 36 may be energized by a spring in such a manner as to automatically rotate in the counterclockwise direction B2. In the normal condition of the mask 1 in which the above-mentioned lever 36 is used, the inspection valve 35 is opened with respect to the inhalation port 47. The filter 13 of the filter unit 3 may be dustproof or gasproof. Also, the filter unit 3 may be made up of a canister known in the field of the technology. The present invention can be applied for the respiratory protection devices, and as illustrated in the example, a dust mask, in which power of lungs of a wearer is used, is a mere example of the respiratory protection devices.

The invention claimed is:

1. A respiratory protection device, comprising:

a facepiece adapted to allow a user to inhale and exhale through the facepiece;

a plurality of filter units provided on the facepiece, and connected to the facepiece in a breathable manner;

air flow paths that respectively extend from the plurality of filter units to the facepiece and merge with each other at a tip end portion of each of the air flow paths;

an inhalation port communicating with an inside of the facepiece at a portion where the air flow paths merge;

a fit checker configured to determine whether a worn condition of the respiratory protection device is appropriate, by temporarily closing the inhalation port and temporarily blocking a flow of inhalation into the facepiece, in a back-and-forth direction perpendicular to an up-and-down direction of the facepiece;

an inspection valve included in the fit checker and configured to temporarily close the inhalation port; and an operation lever connected to the inspection valve, wherein the operation lever is configured to be turned along an arc to cause the inspection valve to be moved in the back-and-forth direction of the facepiece, wherein a deformable tubular portion airtightly seals the operation lever when the operation lever is turned along the arc.

2. The respiratory protection device according to claim 1, wherein the operation lever is positioned at a lower portion of the facepiece.

* * * * *